US006257044B1

(12) United States Patent
Dickerson

(10) Patent No.: US 6,257,044 B1
(45) Date of Patent: Jul. 10, 2001

(54) STOCK PUSHER

(75) Inventor: Jack Laverne Dickerson, Chillicothe, MO (US)

(73) Assignee: Dickerson Tool & Engineering, LP, Chillicothe, MO (US)

( * ) Notice: Subject to any disclaimer, the term of this patent is extended or adjusted under 35 U.S.C. 154(b) by 0 days.

(21) Appl. No.: 09/507,457

(22) Filed: Feb. 22, 2000

(51) Int. Cl.[7] ..... B21J 13/10
(52) U.S. Cl. ..... 72/420; 83/418; 414/19
(58) Field of Search ..... 72/419, 420, 422; 83/418, 419, 421; 414/14, 18, 19

(56) References Cited

U.S. PATENT DOCUMENTS

| | | | | |
|---|---|---|---|---|
| 1,894,718 | * | 1/1933 | Stern et al. | 72/420 |
| 2,369,551 | | 2/1945 | Feiler | 164/88 |
| 2,665,654 | * | 1/1954 | Lyon | 72/419 |
| 2,964,003 | | 12/1960 | Carper | 113/49 |
| 3,310,973 | * | 3/1967 | Leis | 72/420 |
| 3,400,838 | | 9/1968 | Leis et al. | 214/1.3 |
| 3,516,316 | | 6/1970 | Cooper | 83/419 |
| 3,804,265 | * | 4/1974 | Charnota et al. | 83/419 |
| 5,435,681 | * | 7/1995 | Ueda | 414/19 |

* cited by examiner

*Primary Examiner*—Ed Tolan
(74) *Attorney, Agent, or Firm*—Husch & Eppenberger, LLC; H. Frederick Rusche

(57) ABSTRACT

A device for positioning stock within a metal forming machine has a body containing a pusher arm. The device may use interchangeable standard and reverse pusher arms . The pusher arms mount on pivot pins and have position restoring springs. The springs exert force on the pusher arms at a distance from the pivot pins, thereby inducing a moment in the pusher arm. The pusher arm translates this moment into a lateral force exerted by the pusher arm on a piece of stock metal. The body may be mounted in either a reverse or standard configuration resulting, in combination with the use of either the standard or reverse pusher arm, in the ability to exert a lateral force in different directions depending on the configuration used. The device may also have a single pusher arm which may be used in either configuration.

25 Claims, 8 Drawing Sheets

STOCK PUSHER

TECHNICAL FIELD

This invention relates generally to the metal forming industry and, more particularly, to devices for positioning stock within a metal forming machine, such as in a sheet metal punch.

BACKGROUND OF THE INVENTION

The applicant is aware of the following U.S. patents, the disclosures of which are incorporated by reference herein:

U.S. Pat. No. 2,369,551

U.S. Pat. No. 2,964,003

U.S. Pat. No. 3,400,838

U.S. Pat. No. 3,516,316

Stock pushers or crowders are known in the prior art. These devices are designed to assist in the metal forming process by assuring that stock pieces are properly positioned against a reference surface within a metal forming machine prior to the start of a machine cycle. This assures that the metal forming process, whether it be bending, punching or cutting, is performed in the same manner and at the same position on each piece of stock that is inserted into the machine.

For example, a design known from U.S. Pat. No. 3,400,838 discloses a device which has a lever, a compression spring, a cam, and a pivotal arm. The lever and compression spring are mounted to the moving die shoe of the metal forming machine. The cam is attached to the pivotal arm, which, in turn, is attached to a stripper plate located immediately above the stock piece. The compression spring urges the lever in a lateral direction towards the cam and pivotal arm. When the machine lowers the die shoe into its operating position, the lever comes into contact with the cam. The lever then forces the cam and the pivotal arm to move towards the stock until the pivotal arm makes contact with the stock and forces it against a reference surface. When the metal forming operation is complete, the lever is raised, allowing the cam and pivotal arm to move away from the stock. This design takes up considerable space within a metal forming machine and, due to its two-element design, requires realignment between the lever and cam/pivotal arm anytime the device is moved or the machine setup is adjusted.

Similarly, U.S. Pat. No. 2,369,551 also discloses a device which uses a depending lever to contact the stock. The lever is biased by an external spring.

U.S. Pat. No. 3,516,316 discloses a different design. An arm is pivotally attached to a moving stripper plate within a metal forming machine. A torsion spring urges the arm to pivot downward towards the workpiece holder so that one end of the arm extends below the bottom surface of the stripper plate. The stripper plate and pivoting arm are moved downward when the machine tool is moved downward for operation. The end of the arm comes into contact with the workpiece holder before the stripper plate and is forced to rotate against the force of the torsion spring and towards the stock. Prior to the stripper plate engaging the stock, the arm makes contact with the stock piece and forces it against a reference surface. When the operation is complete, the tool and stripper plate are raised, allowing the pivoting arm to rotate away from the stock and back to its starting position.

Another design is illustrated in U.S. Pat. No. 2,964,003. The design of this stock crowder has a unit that mounts directly to the moving die shoe which holds the machine tool. The unit has a mount; a pivoting, L-shaped lever; and a compression spring. The shorter leg of the L-shaped lever extends horizontally away from a pivot point. The longer leg of the lever extends vertically downward towards the stock piece. The compression spring, contained within the mount, acts on the shorter leg of the lever to create a moment in the lever about the pivot point. This moment urges the longer end of the lever into contact with the stock. The lever then forces the stock against a reference surface. In this design, the mount and lever occupy considerable space within a metal forming machine due in large part to the L-shaped design of the lever. When the user desires to change the direction of force applied by the device, a separate mount and lever must be used and the moving die shoe must be adapted to accommodate a seat for the compression spring.

SUMMARY OF THE INVENTION

The stock crowder of the present invention has a containing body with a pusher arm pivotably mounted in the body. The stock crowder may be mounted in a metal forming machine in either a standard or a reverse configuration. The pusher arm has a pivot pin adjacent to one end that forms a pivot point with the main body. The body contains a spring which is engaged with the pusher arm at a distance from the pivot point and provides a force necessary to create a moment about the pivot point. A standard pusher arm and a reverse pusher arm may be provided for use when the main body is mounted in the standard or reverse configuration, respectively. Alternatively, a single pusher arm may be adapted to both configurations, as described herein. In the invention's standard configuration, the spring, which may be a tension spring or a compression spring, exerts a force below the pivot point, thereby creating a moment and a resultant force in one direction. In the reverse configuration, the spring exerts a force above the pivot point, thereby creating a moment and a resultant force in the opposite direction as that obtained in the standard configuration.

An object of the present invention is to provide a more compact and rigid positioning device that will use less space within a metal forming machine.

Another object of the invention is to provide a stock pusher which fits in a wider range of metal forming machines and requires fewer mounting or adapting pieces.

Another object of the present invention is to provide a positioning device that is capable of operating in several modes, providing flexibility in use while reducing the number of parts required for this feature.

These and other objects, aspects, features and advantages of the present invention will become apparent from the following detailed description when taken in conjunction with the reference drawings.

DESCRIPTION OF THE DRAWINGS

FIG. 3 is a series of side views of the standard and reverse pusher arms.

DESCRIPTION OF THE PREFERRED EMBODIMENTS

Figure 1:
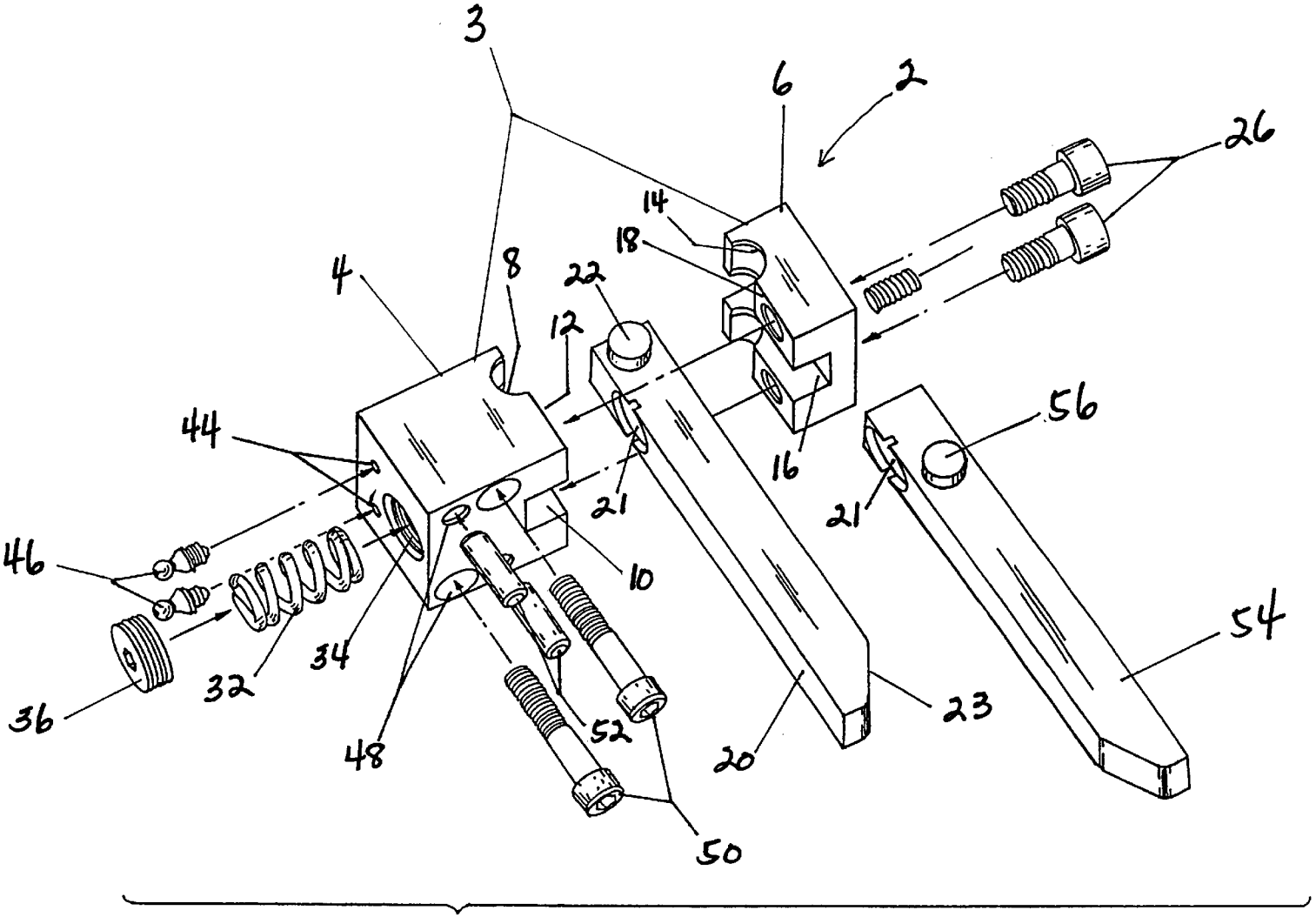
FIG. 1 is an exploded perspective view of a stock pusher, according to the invention, in a standard configuration.

Reference is now made to the drawings which illustrate the best known mode of carrying out the invention and wherein the same reference numerals indicate the same or similar parts throughout the several views.

Figure 2:
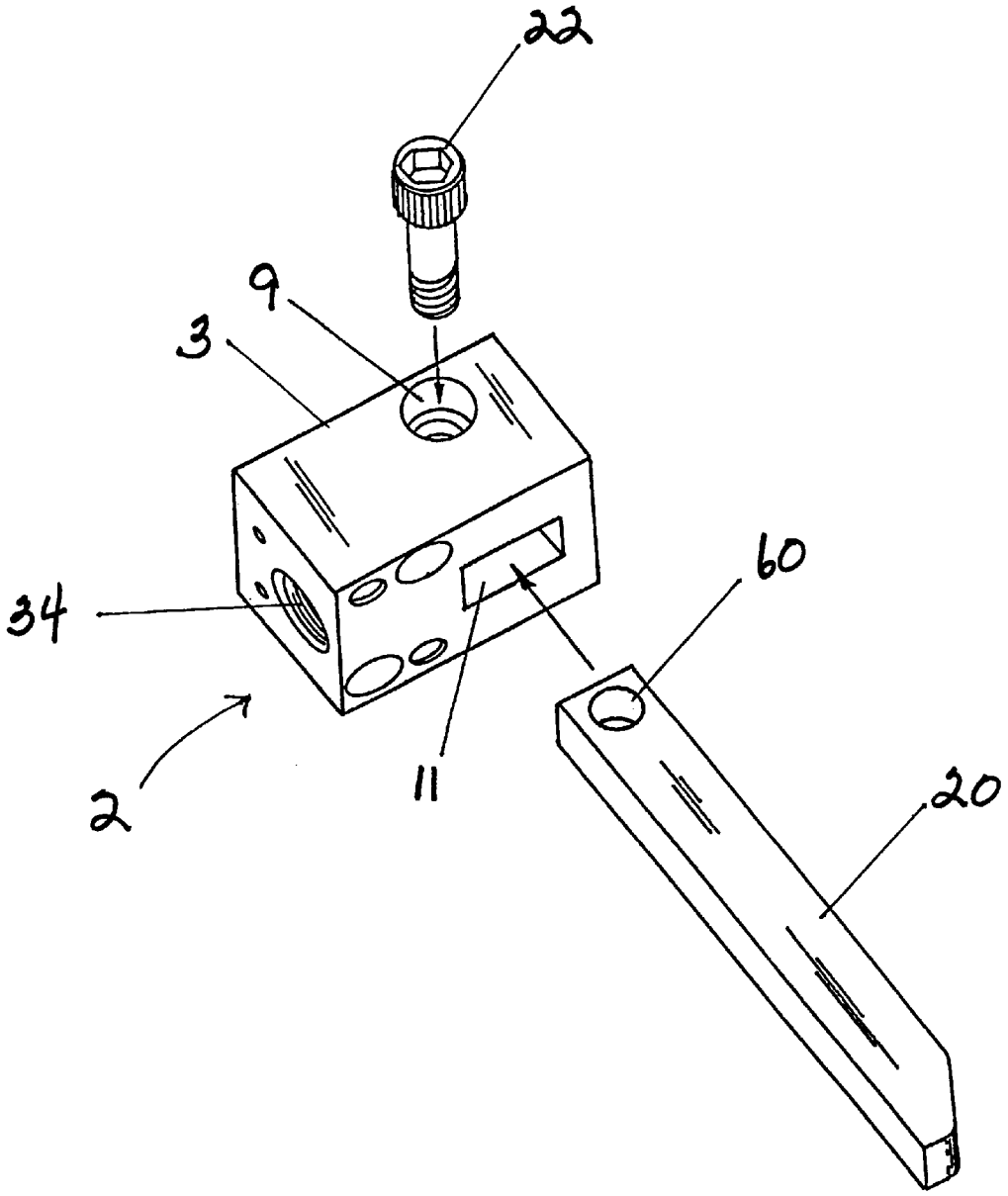
FIG. 2 is an exploded perspective view of an alternate embodiment of the stock pusher.
Figure 4:
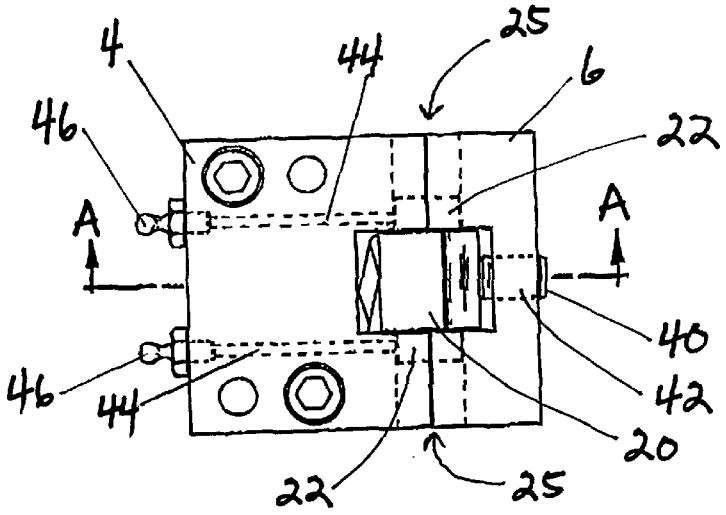
FIG. 4 is a bottom view with hidden lines shown of a stock pusher in a standard configuration.
Figure 5:
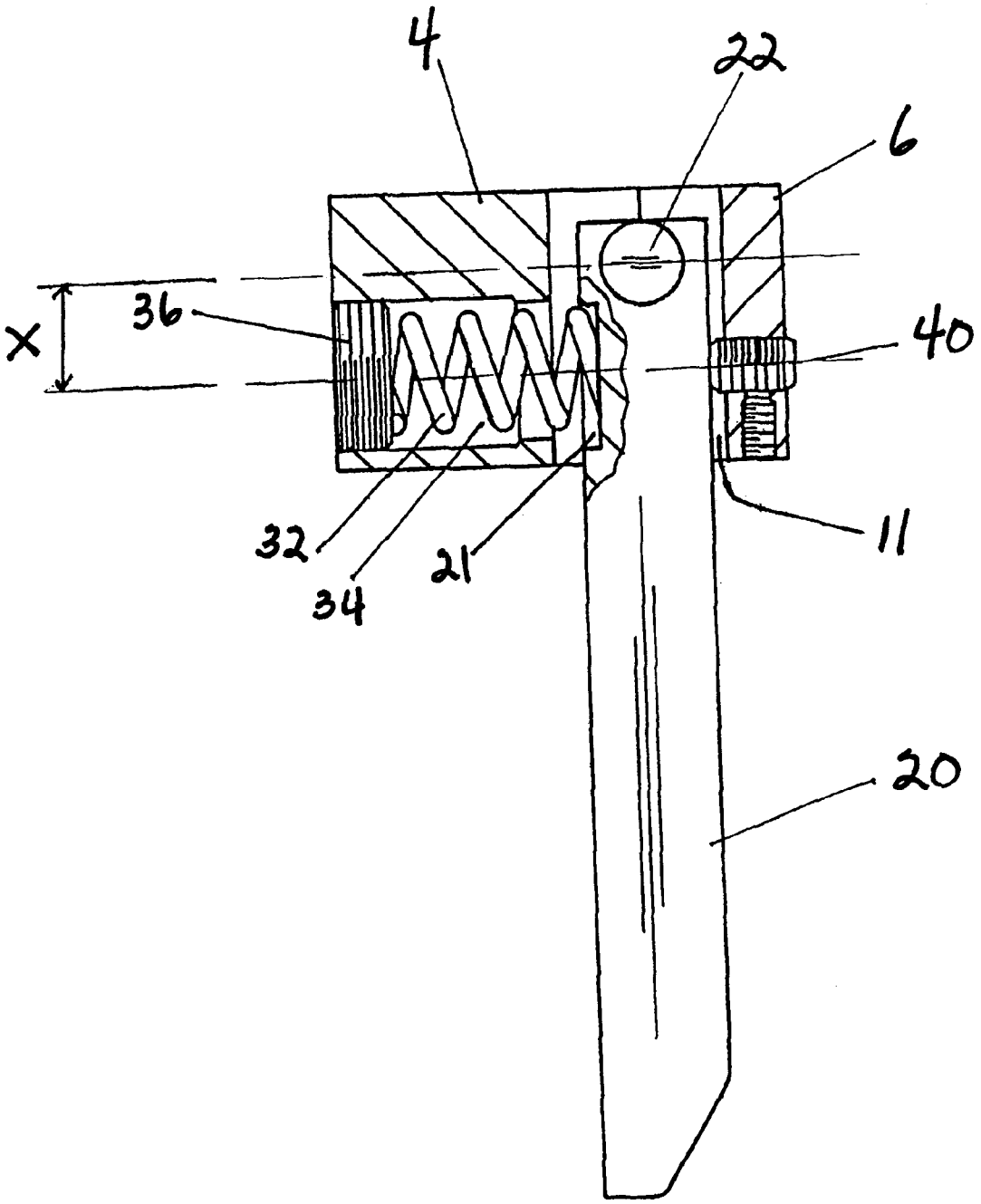
FIG. 5 is a cross-sectional view of the stock pusher from section line A—A of FIG. 4.
Figure 6:
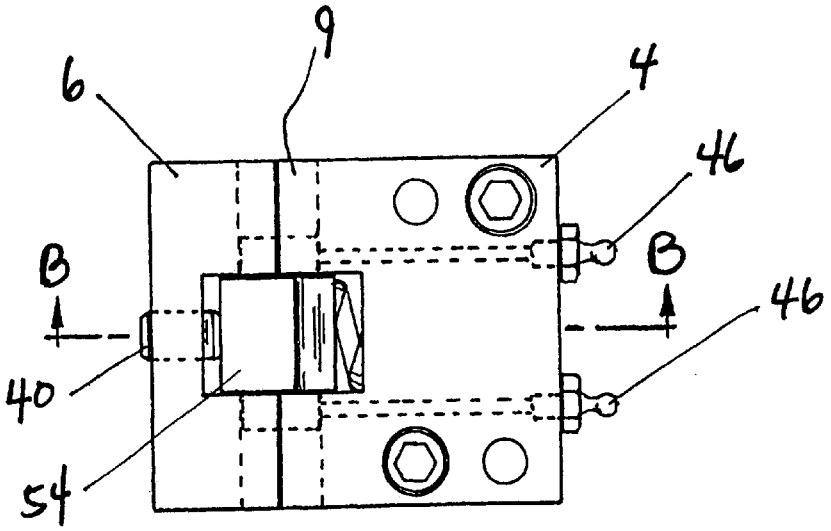
FIG. 6 is a bottom view of a stock pusher in a reverse configuration.
Figure 10:
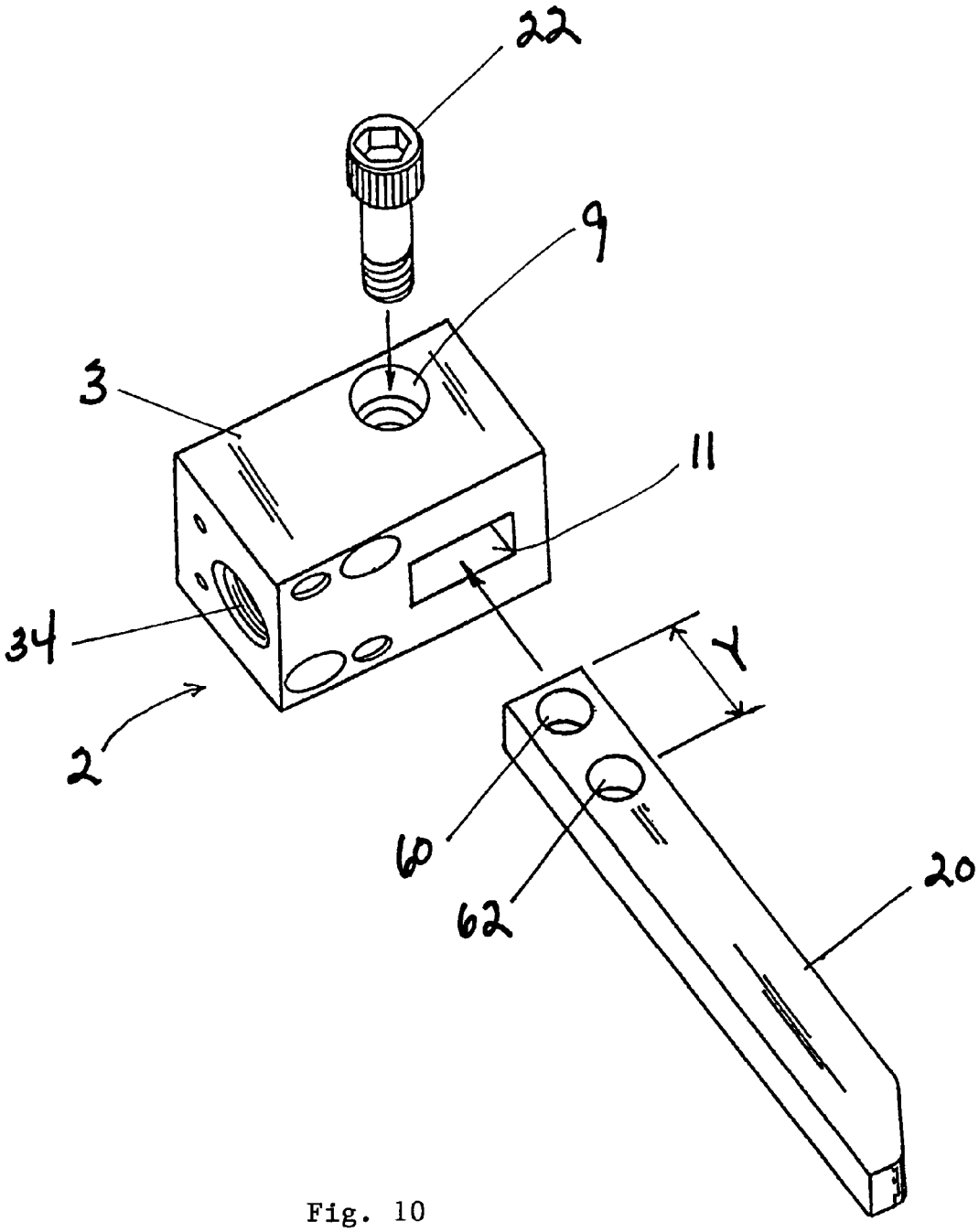
FIG. 10 is an exploded perspective view of a stock pusher, according to an alternate embodiment of the invention.

A stock pusher 2 according to the present invention is shown in FIG. 1. The stock pusher 2, of FIG. 1, has a two piece body 3 made with a base 4 and a cap 6. The base 4 contains a semicircular channel 8 and a substantially rectangular channel 10 along a cap face 12. The cap 6 contains a semi-circular channel 14 and a substantially rectangular channel 16 along a base face 18 which match the semicircular channel 8 and substantially rectangular channel 10 of the base 4 to form channels 9 and 11, as shown in FIGS. 5 and 6. It will be appreciated that the channels 9 and 11 may be of cross sections other than those shown and still provide the required function, as described herein. A standard pusher arm 20 of linear design has spring pocket 21, as shown, and has a cylindrical pivot pin 22 adjacent to one end and an angled surface 23 at the opposite end. The stock pusher, including pusher arm 20, is preferably made of a strong durable material, such as 4140 pre-hardened aluminum or an equivalent sturdy structural material, as is known in the art. The base 4 and cap 6 especially may be made of such material. The pivot pin 22 may be either integrated with the pusher arm 20 or a separate piece, or pieces which slides into an aperture contained in the pusher arm 20. When the base 4 and cap 6 are joined, the channel 9 receives and hold in place the pivot pin 22 on either side of the pusher arm 20, forming two pivot points 25, while the channel 11 restricts movement of the pusher arm 20 to a single plane. It will be appreciated that other shapes may be used for channel 11; it may be circular in cross-section, for example. In that configuration, a slotted disc or guide bars, not shown, may be used to guide pusher arm 20. The joined base 4 and cap 6 allow the pusher arm 20 to move about the pivot points. The base 4 and cap 6 may be held together by any standard, removable joining means 26, such as screws or bolts. It will be appreciated that other shapes may also be used for pivot pin 22 and pivot points 23, as is known in the art. For example, pivot pin 22 may be of compound shape such as a rectangle with curved ends which cooperate with the curvature of channel 9, or a bolt or other fastener as shown in FIGS. 2 and 10.

The pusher 2 applies a force to the pusher arm 20 at a distance from the cylindrical pivot pin 22 to create a moment about the pivot points 25, for example, at a distance X, as shown. This force may be supplied by a compression spring 32 contained in a bore 34 within the base 4. The compression spring 32 may be held within the bore 34 by a threaded plug 36, as shown. Any suitable compression spring 32 , such as a conventional steel spring for example, may be used. The pusher arm 20 may be provided with a recessed area, or pocket 21 to receive an end of the compression spring 32. The amount of force applied to the pusher arm 20 may be adjusted both by adjusting the plug 36 to control the level of preset compression placed on the spring 32 and by using springs of varying stiffness and length. It will be appreciated that a tension spring, not shown, may also be used instead of compression spring 32, for example by reversing the location of bore 34. Bore 34 may also be of other cross-sections, for example, of square cross-section. Further, spring 32 may be held in bore 34 by other keepers and fasteners, such as by a snap-ring.

Figure 9:
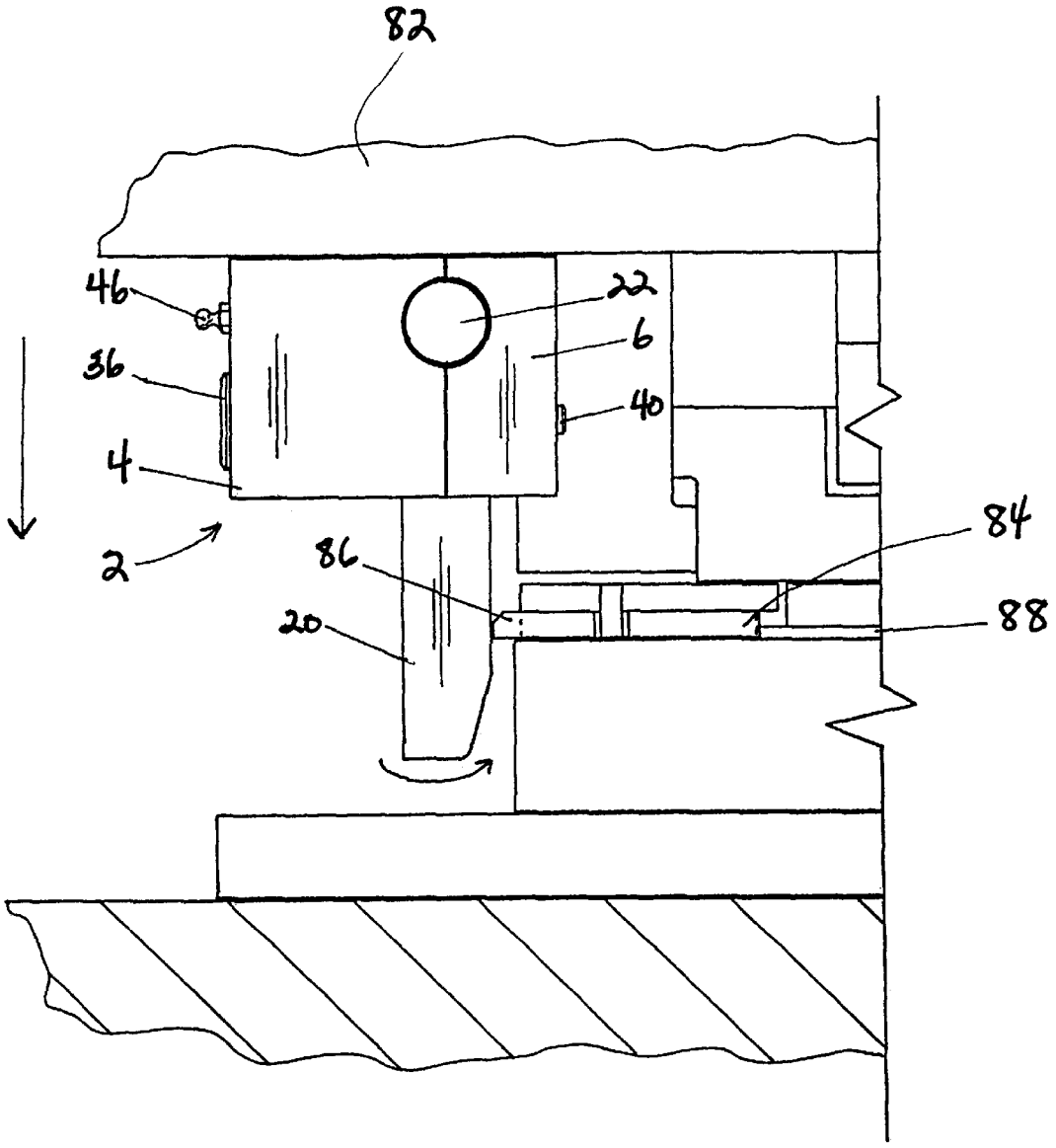
FIG. 9 is a partial schematic view of a stock in a standard configuration as installed in a metal forming machine.

The compression spring 32 tends to force the pusher arm 20 to rotate about the pivot points 25, away from the base 4. When the device is used in a metal forming machine as shown in FIG. 9, this movement will bring the pusher arm 20 into contact with whatever stock or workpiece is placed in the machine and force the stock into position against a reference surface. The force of the pusher arm 20 will be applied to the stock throughout the operation of the machine, insuring that the workpiece is in the proper position for whatever metal forming operation is performed.

When the work piece is removed from the machine, the force of the compression spring 32 will rotate the pusher arm 20 until it encounters the wall of the channel 11. A stop for restricting this movement may be provided in the device, for example, by stop screw 40 inserted into a threaded hole 42 contained in the cap 6, as shown in FIG. 5. The distance which the stop screw 40 extends into the pusher arm's movement may be adjusted simply by turning the screw 40 one way or another. The position of stop screw 40 may be fixed by a set screw 41, as shown.

Because proper operation of the device requires that the pusher arm 20 be able to freely pivot within the pivot points, lubrication of the pivot pin 22 and channel 9 may be provided. For example, one or more bores 44 through the base 4 leading to the channel 9 may be provided, as shown. Grease fittings 46 may be inserted into the bores 44 to aid in the delivery and retention of lubricant. Alternatively, pivot pin 22 and channel 9 may be provided with a self lubricating coating, as known in the art.

Figure 8A:
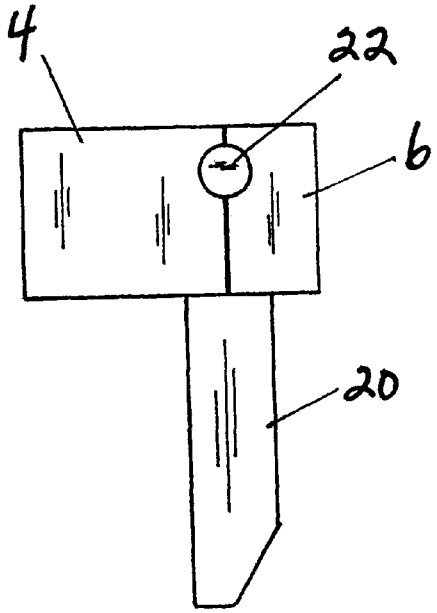
FIG. 8A is an elevation view of a stock pusher in a standard configuration.
Figure 8B:
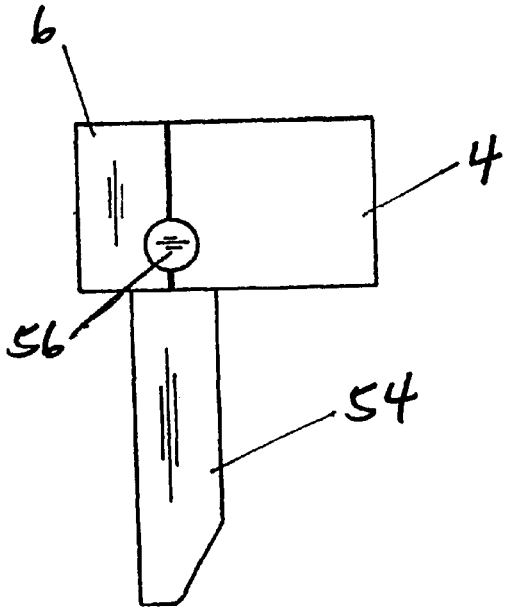
FIG. 8B is an elevation view of a stock pusher in a reverse configuration.

Pusher 2 will generally be mounted to an upper, moveable portion of the metal forming machine 80, as seen in FIG. 9. This mounting may be accomplished by a plurality of bores 48 through the body 2. Screws 50 and/or dowels 52 may be inserted through the bores 48 and into the upper portion of the metal forming machine 80. This mounting system allows the cap 6 and pusher arm 20 to be removed from the device while leaving the base 4 mounted to the metal forming machine. In addition, this system allows the pusher 2 to be installed in either a standard configuration or a reverse configuration simply by rotating the base 4 and cap 6 180° about the horizontal and vertical axes, as illustrated in FIG. 8A and 8B. It will also be appreciated that a plurality of bores 48 may be placed on pusher 2, including on cap 6, not shown. The placing of the bores 48 may permit a single pusher design to be used in a variety of installations.

Figures 3A, 3B, 3C, 3D:
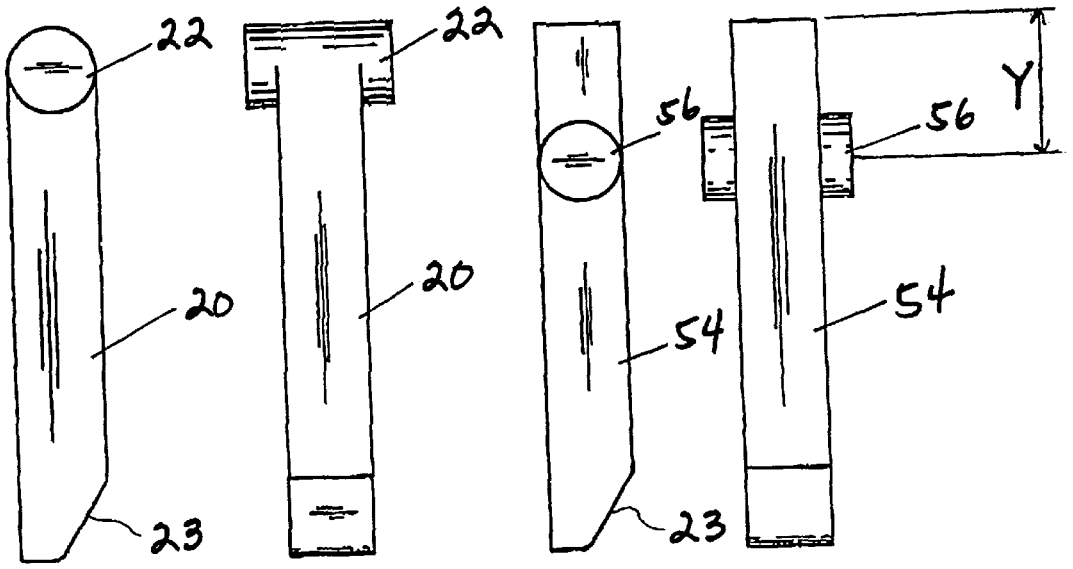
FIGS. 3A and 3B are side views of a standard pusher arm.
FIGS. 3C and 3D are side views of a reverse pusher arm.
Figure 7:
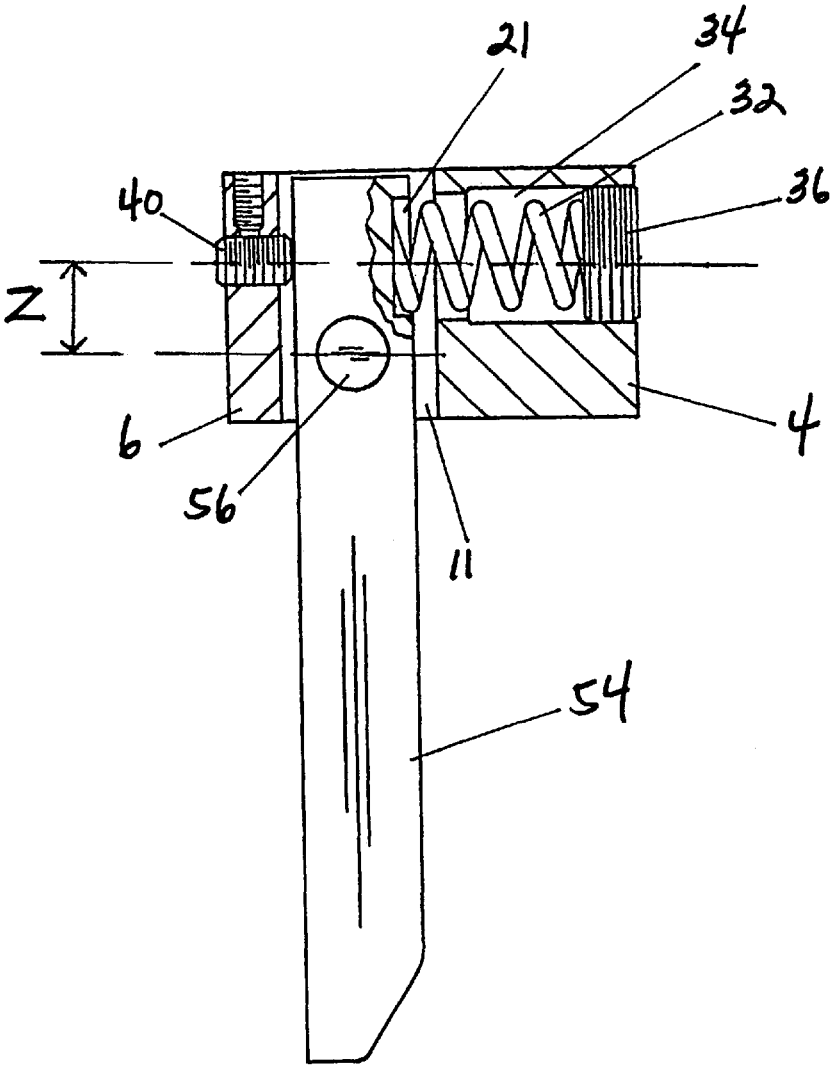
FIG. 7 is a cross-sectional view of the stock pusher from section line B—B of FIG. 6.

The capability of installing the pusher 2 in two positions makes the entire device capable of exerting a force in two different directions with only a minimal need for interchanging parts. In order to reverse the direction of force, only the pusher arm 20 must be replaced. A reverse pusher arm 54, as shown in FIGS. 1, 3C and 3D, may be used in place of the standard pusher arm 20. As opposed to the standard pusher arm 20, wherein the pivot pin 22 is positioned substantially at one end of the arm 20, the reverse pusher arm 54 possesses a cylindrical pivot pin 56 that is spaced a distance, Y, from the end of the arm 54, as shown in FIG. 3D. This change of position of the pivot pin in combination with the rotation of the base 4 and cap 6 by 180° about the horizontal axis places the spring 32 in contact with the reverse pusher arm 54 at a distance, Z, above the pivot pin 56, as shown in FIG. 7. This is in contrast to the standard configuration in which the spring 32 contacts the pusher arm 20 below the pivot pin 22. Other than the position 20 of the pivot pin 56 the design and usage of the reverse pusher arm 54 is similar to that of the standard pusher arm 20.

The reverse configuration results in a moment being imparted to the reverse pusher arm 54 in the opposite direction of the moment induced in the standard pusher arm 20. In turn, the direction of force applied by the reverse pusher arm 54 is opposite that imposed by the standard pusher arm 20. Only one new part is required to accomplish this change in direction. If desired, a single pusher arm 20 may be modified to perform the duties of both the standard 20 and reverse pusher arms 54, as shown in FIG. 10, by simply providing a pusher arm 20 with two pivot holes 60, 62. The pivot holes 60, 62 permit the pusher arm 22, shown in FIG. 10, to be reversed as described herein with reference to FIGS. 8A and 8B. In the alternate embodiment as shown in FIG. 2 and FIG. 10, the body 3 of pusher 2 may be a single piece.

OPERATION OF THE DEVICE

During operation, the pusher 2 may be mounted to the die shoe 82 of a metal forming machine 80, as shown in FIG. 9. The spring 32 exerts a force on either the standard pusher arm 20, as shown or the reverse pusher arm 54, at a distance from the pivot points 25 and pivot pins 22. This creates a moment about the pivot points 25 and makes the pusher arm 20 or 54, rotate about the pivot points 25, as described herein. When the die shoe 82 of stamping machine 80 advances toward workpiece 84, pusher arm 20 contacts the edge 86 of workpiece 84, as shown. The force supplied to pusher arm 20 by spring 32 is translated to workpiece 84 and forces workpiece 84 firmly against positioning stop 88, as shown. The workpiece 84 is held against positioning stop 88, to maintain the accuracy of the performed operation, until the operation of the stamping machine completes the desired work on the workpiece 84. The stamping machine 80, with pusher 2, can then return to its initial position in preparation for another cyle.

Other objects, features and advantages of the present invention will be apparent to those skilled in the art. While preferred embodiments of the present invention have been illustrated and described, this has been by way of illustration and the invention should not be limited except as required by the scope of the appended claims and their equivalents.

I claim:

1. A device for positioning stock within a metal forming machine, comprising:

a body for supporting a pusher arm, the body having a first transverse aperture extending at least partially through the body, the first transverse aperture receiving a pivot pin for a pusher arm, the pivot pin permitting pivoting movement in relation to the pivot pin, the body further having a longitudinal aperture extending therethrough, the longitudinal aperture extending substantially at a right angle to the first transverse aperture and communicating therewith, the longitudinal aperture receiving a pusher arm therein and the pivot pin cooperating with the pusher arm to provide a pivot and support the pusher arm, the body further having a second transverse aperture extending at least partially therethrough, the second transverse aperture extending substantially at a right angle to the first transverse aperture and being spaced therefrom, the second transverse aperture extending substantially at a right angle to the longitudinal aperture and communicating therewith, the second transverse aperture receiving a spring therein, the spring extending into the longitudinal aperture whereby the spring can cooperate with the pusher arm received in the longitudinal aperture of the body to apply a pivoting force to the pusher arm.

2. A device for positioning stock within a metal forming machine according to claim 1, wherein the pusher arm has first and second ends and the pusher arm and pivot pin cooperate to form a pivot for the pusher arm adjacent to the first end.

3. A device for positioning stock within a metal forming machine according to claim 1, wherein the pusher arm has first and second ends and the pusher arm and pivot pin cooperate to form a pivot for the pusher arm spaced from the first end.

4. A device for positioning stock within a metal forming machine according to claim 1, wherein the body is comprised of a base and a cap joined together.

5. A device for positioning stock within a metal forming machine according to claim 1, wherein the body is a single piece.

6. A device for positioning stock within a metal forming machine according to claim 1, wherein the body contains a plurality of mounting holes extending through the body which allows the body to be installed in a metal forming machine in alternative configurations.

7. A device for positioning stock within a metal forming machine according to claim 1, wherein the spring is contained within the second aperture is a compression spring and wherein a retainer in the aperture induces an amount of preset compression in the compression spring.

8. A device for positioning stock within a metal forming machine according to claim 7, wherein the retainer is a plug which may be moved within the second aperture in order to increase or decrease the amount of preset compression in the compression spring.

9. A device for positioning stock within a metal forming machine according to claim 1, wherein the body contains at least one passage extending partially through the body and communicating with the first transverse aperture, whereby lubrication may be supplied to the pivot pin through the passage.

10. A device for positioning stock within a metal forming machine according to claim 1, wherein the pivot pin is integral with the pusher arm and the pivot pin and pusher arm are formed from a single solid piece of material.

11. A device for positioning stock within a metal forming machine, comprising:

a base;

a cap joined to the base;

a pusher arm of linear design with first and second ends and containing an aperture adjacent to the first end;

a pivot pin which fits into the aperture of the pusher arm and is held between the base and the cap;

a compression spring contained within the base which makes contact with and exerts a force on the pusher arm at a distance spaced from the pivot pin.

12. A device for positioning stock within a metal forming machine according to claim 11, including:

a reverse pusher arm, interchangeable with the pusher arm, with first and second ends and containing an aperture at a distance, spaced from the first end.

13. A device for positioning stock within a metal forming machine according to claim 11, wherein the pusher arm contains a second aperture extending through the pusher arm at a distance, spaced from the first end, whereby the pivot pin may be inserted into either the first or second aperture.

14. A device for positioning stock within a metal forming machine according to claim 11, wherein the compression spring is held within the base by a retainer which also induces an amount of preset compression in the compression spring.

15. A device for positioning stock within a metal forming machine according to claim 14, wherein the retainer is a threaded plug which may be moved within the base in order to increase or decrease the amount of preset compression in the compression spring.

16. A device for positioning stock within a metal forming machine, comprising:

a base with a cap face and containing:

a substantially rectangular channel extending along the cap face;

a semi-circular channel extending along the cap face perpendicular to and intersecting with the substantially rectangular channel;

a first circular aperture perpendicular to the substantially rectangular and semicircular channels and intersecting with the substantially rectangular channel;

a cap, with a base face that mates to the cap face of the base and containing;

a substantially rectangular channel extending along the base face;

a semi-circular channel extending along the base face perpendicular to and intersecting with the substantially rectangular channel;

a pusher arm of linear design with a long axis and first and second ends which fits into a substantially rectangular aperture formed by the substantially rectangular channels of the base and cap and contains a hole extending through the pusher arm adjacent to the first end perpendicular to the long axis;

a cylindrical pivot pin with first and second ends which fits through a second circular aperture formed by the semi-circular channels of the base and cap and into the hole of the pusher arm to form a pivot point between the main body and the pusher arm;

a compression spring contained within the first circular aperture of the base and which makes contact with and exerts a force on the pusher arm at a distance, spaced from the pivot point.

17. A device for positioning stock within a metal forming machine according to claim 16, wherein the pusher arm has an angled surface adjacent to the second end.

18. A device for positioning stock within a metal forming machine according to claim 16, wherein the cap contains a threaded hole leading from a face opposite the base face to the substantially rectangular channel of the cap, and including a screw threaded into the threaded hole, the screw limiting the range of movement of the pusher arm.

19. A device for positioning stock within a metal forming machine according to claim 16, including:

a reverse pusher arm, interchangeable with the pusher arm, with a long axis and first and second ends which fits into the substantially rectangular aperture and contains a hole extending through the pusher arm at a distance, spaced from the first end perpendicular to the long axis.

20. A device for positioning stock within a metal forming machine according to claim 16, wherein the pusher arm contains a second hole extending through the pusher arm at a distance, spaced from the first end perpendicular to the long axis, whereby the pivot pin may inserted into either the first or second hole.

21. A device for positioning stock within a metal forming machine according to claim 16, wherein the compression spring is held within the first circular aperture by a plug which also induces an amount of preset compression in the compression spring and wherein the plug may be moved to change the amount of preset compression in the compression spring.

22. A device for positioning stock within a metal forming machine, comprising:

a main body with a horizontal axis and a vertical axis and containing:

a substantially rectangular aperture extending substantially through the main body and parallel to the vertical axis;

a first circular aperture extending substantially through the main body perpendicular to the vertical and horizontal axes, and intersecting with the substantially rectangular aperture;

a second circular aperture parallel to the horizontal axis and intersecting with the substantially rectangular aperture;

a pusher arm with a long axis, and first and second ends, which fits into the substantially rectangular aperture and contains a hole extending through the pusher arm at the first end, the hole being perpendicular to the long axis;

a cylindrical pivot pin with first and second ends which fits through the first circular aperture and into the hole of the pusher arm to form a pivot point between the main body and the pusher arm;

a compression spring contained within the second circular aperture and which makes contact with and exerts a force on the pusher arm at a distance, spaced from the pivot point.

23. A device for positioning stock within a metal forming machine according to claim 22, including a threaded hole parallel to the horizontal axis leading from one face of the main body to the substantially rectangular aperture, and including a screw threaded into the threaded hole for limiting the range of movement of the pusher arm.

24. A device for positioning stock within a metal forming machine according to claim 22, wherein the main body contains a plurality of mounting holes extending through the main body parallel to the vertical axis which allow the main body to be installed in a metal forming machine in either a standard configuration or a reverse configuration by rotating the main body 180° about the horizontal axis.

25. A device for positioning stock within a metal forming machine according to claim 22, wherein the pusher arm contains a second hole extending through the pusher arm at a distance, spaced from the first end and perpendicular to the vertical axis, whereby the cylindrical pivot pin may inserted into either the first or second hole.

* * * * *